United States Patent [19]

Dubach et al.

[11] 4,170,315

[45] Oct. 9, 1979

[54] CLOSURE FOR RIGID AND DEFORMABLE CONTAINERS

[75] Inventors: Werner F. Dubach, Wallisellen; Hansruedi Kessler, Hallau, both of Switzerland

[73] Assignee: Createchnic Patent AG, Wallisellen, Switzerland

[21] Appl. No.: 876,734

[22] Filed: Feb. 10, 1978

[30] Foreign Application Priority Data

Feb. 10, 1977 [CH] Switzerland ..... 1611/77
Jul. 22, 1977 [CH] Switzerland ..... 9115/77

[51] Int. Cl.[2] ..... B65D 43/04

[52] U.S. Cl. ..... 220/281; 220/375; 220/339; 222/153

[58] Field of Search ..... 220/375, 306, 281, 339; 215/211, 224, 225, 301; 222/153, 546, 556, 545

[56] References Cited

U.S. PATENT DOCUMENTS 3,873,006 3/1975 Fields ..... 222/153
4,022,352 5/1977 Pehr ..... 220/375 X

*Primary Examiner*—George T. Hall
*Attorney, Agent, or Firm*—Karl F. Ross

[57] ABSTRACT

A closure of synthetic resin material has a cap connected to a base which fits onto the container by a hinge joint which may be of the flexible film type and can be molded unitarily with the base and cap. On the opposite side of the cap from the hinge, there is provided a lever which has a pressing plate and a hook, the latter being engageable with a detent on the base so that entered pressure on the plate allows the cap to swing upwardly.

30 Claims, 16 Drawing Figures

CLOSURE FOR RIGID AND DEFORMABLE CONTAINERS

FIELD OF INVENTION

The invention relates to a closure of synthetic-resin material for rigid or deformable containers, such as: glass bottles, cans, synthetic-resin bottles, tubes and the like, and to a method of operating such a closure having a lower member mounted on the container, with at least one outlet opening and a cap hinged to the lower member with a sealing member.

BACKGROUND OF THE INVENTION

There are many closures available on the market, but each of them is always to be used only in a specific case. There are closures for tubes, closures for bottles, closures for cans, etc.

Besides this classification based upon their application, the closures can also be divided according to the way they function, such as rotatable closures, snap closures and press closures. The closures currently used are mostly formed as sheet metal caps or are formed from synthetic-resin material.

An ideal synthetic-resin closure would have to fulfill the following partly contradictory requirements:

1. the closure must seal tightly, but be easily openable, when possible, by one hand;
2. the closure should be capable of withstanding a certain internal pressure as arises especially in the case of carbonated beverages;
3. the closure should be capable of withstanding temperatures of the type arising during pasteurization (62° to 85° C.);
4. the closure should be able to be made as a child-proof unit, without major modification;
5. the closure should be capable of sealing tightly glass bottles having a wide range of tolerances at their mouths; and
6. the closure should, without major modifications, be able to be provided with a sealing band.

All of the conventional closures have the disadvantage that they fulfill at most four of the above-listed requirements. Particularly, to date there has not been developed a closure in which a cover and a base are connected to each other and which is capable of simultaneously sealing the container against internal pressure and withstanding high temperatures. In the case of pressure-tight closures, it is usually difficult to open the closure with one hand without applying a high degree of force to the container. The previously known closures can be applied to solving different closure problems only after major modifications. Pressure-tight closures, for instance, can hardly be used for closing pressureless containers which must be opened and closed repeatedly.

OBJECT OF THE INVENTION

It is the object of the invention to provide a closure capable of fulfilling all the listed requirements of an ideal closure and of avoiding all the known disadvantages of the known closures.

SUMMARY OF THE INVENTION

This object is attained by the invention in a closure unit characterized by the fact that the cap is provided with at least one lever-type projection or extension, opposite the hinge, this projection being articulatedly connected with the cap and being formed with at least one pressing surface and at least one hook, and the base having at least one detent formation.

Preferably, the extension has a flap or plate configuration and is secured at its upper end elastically with the cap, while the pressure surface is provided at the lower end of the extension, and the hook-shaped formation or projection is provided at an intermediate region thereof.

In a further advantageous embodiment of the invention, the formation or projection is plate-shaped and is elastically connected with the cap at an intermediate region, while the pressing surface is provided at the upper end and the hook-shaped formation is provided at the lower end of the plate.

The cap is kept in a closed position in relation to the lower member or base on one hand by the fact that the hinge constitutes a joint or connection which in the closed state can be stressfree or under prestress, and, on the other hand, the fact that the hook-shaped formation and the detent pin on the base constitute a second joint or connection. These two joints afford a completely safe closure, such as is in the case of the known lever-type closures with two joints between the upper and the lower part of the closure.

The closure can be opened by applying pressure to the pressing plate on the extension or projection of the cap. The projection or extension is thereby pivoted at the location at which it is connected to the plate. Depending upon the placement of the fulcrum on the projection, the latter can act as a single-arm or double-arm lever. By pivoting the projection about its fulcrum, the articulation between the hook-shaped formation on the projection and the detent formation at the base is released and the cap can be opened and pivoted about the hinge by applying pressure generally parallel to the closure axis. By modification of the distances between the fulcrum of the projection, i.e. the flap or plate, the hook-shaped formations and the force-application point on the pressing plate, it is possible to control the force necessary to open the closure. According to the principle of the invention, it is possible to obtain a closure which, in spite of the forces acting against the closure, for instance high pressure within the container, facilitate a realtively simple and easy opening of the closure.

According to another aspect of the invention, the closure unit is so formed that the projection is constituted by two flaps injection molded onto the cap and separated by a space from one another, each of the flaps having at their lower ends a respective pressure plate and at least one laterally extending injection-molded hook, and the base of the closure unit being provided with two cheeks or flanks each having a detent formation cooperating with a respective one of the hooks. In this case the flaps project somewhat radially from the periphery of the closure unit.

In this embodiment, for the opening, the two flaps have to be pressed towards and counter to each other to release the hooks from the detent pins or formations and thereafter, while maintaining at least for a while the press-together force upon the two flaps, the cap can be pushed upwardly.

The hook-shaped formations on the projection and the detent pin on the base or lower member which engage one another in the closed position of the closure are suitably so formed that the surfaces which mutually engage lie substantially at right angles to the closure axis. This is to avoid any undesired opening or release of the interengaged parts. However, if it is desired to facilitate the opening of a closure according to this invention, the effective surfaces of the hook and the detent pin can be inclined. The angle between the effective surfaces and a perpendicular to the closure axle has to be kept sufficiently small according to the selected material in order to ensure the self-locking of the closure. Under these conditions, the angle between the effective surface of the detent pin at the base and the closure axis will be more than 90°. When an especially tight locking of the cap is desired the effective surfaces can be inclined in the opposite direction, i.e. the effective surface on the base can form an angle with the closure axis of less than 90°, which means that the effective surfaces are undercut.

The hinge between the cap and the base of the closure are suitably formed as a film hinge and, for greater safety of the closure, the film hinge can be flanked by stretchable or yieldable strips which are connected by support elements on their ends with the cap and the base. These strips are mounted as close as possible to the periphery of the closure and also have the function to prevent the cap from closing, when in the open position. The dimensions of the strips and the hinge are modified depending upon the application of the closure and the pressure level in the container.

For additional relief of the hinge or the yield strips, a hook can be injection-molded on the cap close to the hinge, which hook can lock itself in a corresponding opening of the base, when the unit is closed.

The closures according to the present invention can be made child-proof relatively simply. A child-proof closure can be provided by giving the detent pin and the pressing surface on the base a hook-shaped configuration, so that the hooks engage one after the other in the direction of the closure axis. In addition, between the base and the cap, at least one elastically deformable intermediate member is provided, which must be deformed in order to release the hook of the lever from the detent pin of the base. The intermediate member can be arranged on the cap or a spring device, for instance a bow-shaped member (e.g. a bail, hoop or arch); bearing upon the cap, can be mounted in the rear area of the closure on the lower member or base thereof.

In order to open the child-proof closure a force is first applied upon the cap in the direction substantially of the closure aixs pressing the cap against the base and deforming the resilient stressing element between the cap and the base. By this, the hooks on the pressure plate and on the detent pin of the base are released. By applying a pressure in an angle of 90° to the closure axis against the pressure plate, the hooks can be swung apart and the cap can be pushed upwardly and lifted. Tests have shown that children have considerable difficulty in performing the pressing movement against the direction in which the closure units open simultaneously with the actuation of the pressure plate or lever, followed by the opening movement of the cap. This atypical sequence of movements ensures considerable safety which can be increased by an appropriate dimensioning of the spring element so that more pressure has to be applied to release the hooks.

The closures of the present invention thus fulfill all the requirements set forth previously, since all embodiments can be provided with a seal device. The closures can practically be applied in a simple manner to use applications. It can easily be handled with one hand and also makes sure that the cap cannot be lost.

BRIEF DESCRIPTION OF THE DRAWING

Further details of the invention will be described more closely hereinafter in connection with the drawing. They show:

FIGS. 1 through 3 show a synthetic-resin closure formed in one piece, preferably from polypropylene. The principal components of the closure are: a base or lower member 1, a cap 2, a projection or extension 3 joined to the cap 2 having a pressing surface 8 and a hook-shaped projection 9 as well as cheeks 49 and 50 and hinge parts 4, connecting pivotally the base to the cap. The base 1 is provided with an internal screwthread 11 whereby the closure can be screwed onto a container with a corresponding outer thread.

Figure 1:
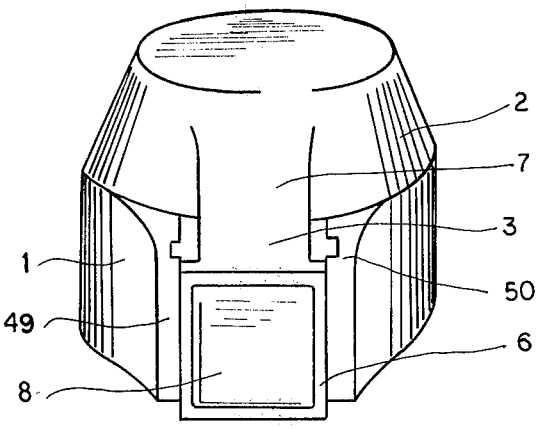
FIG. 1 a front top view of a closure.

Containers with threads are mostly bottles. These are relatively expensive and are accordingly intended for reuse. In order to protect the thread of the empty bottles during transportation, in most of the cases the delivering firm requests that the cap be returned with the bottle. Such a closure has to be completely unscrewed, in order to get access to the content of the bottle, and many times it is improperly screwed on, so that the contents spoil or the cap is lost. The closure of FIGS. 1–3 facilitates the opening of the container through lifting of the cap, without unscrewing the closure. By maintaining the height of the thread 11 on base as low as possible the release of the closure from the injection-molding unit as well as a simple application of the closure to the bottle during refill is facilitated. In the case of filling installations, which also close the container, the rotatable closure is usually pressed on top of the container and then tightened by turning. Due to the high speed and the gas escaping from the bottles to be closed, many closures fall down before being tightened. By keeping the height of thread 11 correspondingly low, the automatic bottle-capping unit can press the closure upon the container, with a portion of the thread 11 coming to rest on the upper portion of the thread of the bottle mouth, preventing the closure from falling down.

The cap 2 is connected with the base 1 by a film hinge 4. In the case of film hinges constituted in accordance with conventional techniques, and using polypropylene, as a material, over one million closing and opening cycles can be imparted on the closure and a very safe articulation between the base 1 and the cap 2 is ensured.

On the periphery of the closure, at the cap 2 opposite the hinge 4 lies the lever 3 which is molded to the cap 2 at his upper end 7. At the lower end of the lever 3 a pressing plate 8 is provided, as well as two hook-shaped formations 9, placed in the middle area of the projection. These two hook-shaped formations are mounted on the connecting ribs 32, molded to the lever 3. The base 1 is provided on both sides of the projection 3 with a pair of cheeks 49 and 50, having each a guiding channel 42. The ribs 32 on the projection 3 move along this guiding channels 42. The two cheeks 49 and 50 each have a detent pin 12 which in the closed position of the closure cooperates through the effective surfaces 28 with the effective surfaces 27 of the hook-shaped formations 9 situated on projection 3. The formations 9 and 12 are unidirectionally inclined, so that they can easily snap together when the unit is closed. The lever 3 is so prestressed that the hooks 9 engage immediately behind the detent pins 12 thereby preventing an opening of the closure.

The base 1 has a centering peg, apron or boss 22 which surrounds the discharge opening 52. This centering peg 22 forms a seal between the closure and the inner wall of the discharge opening of the container. In the cap 2, a sealing peg 21 is provided, which in the closed state of the closure enters the discharge opening 52, sealing off the base 1. In order to improve the tightness of the sealing effects between the inner wall of the centering peg 22 and the outer wall of the sealing 21, the latter is provided on its outside with two sealing rings 23, which ensure a fool-proof seal.

Figure 2:
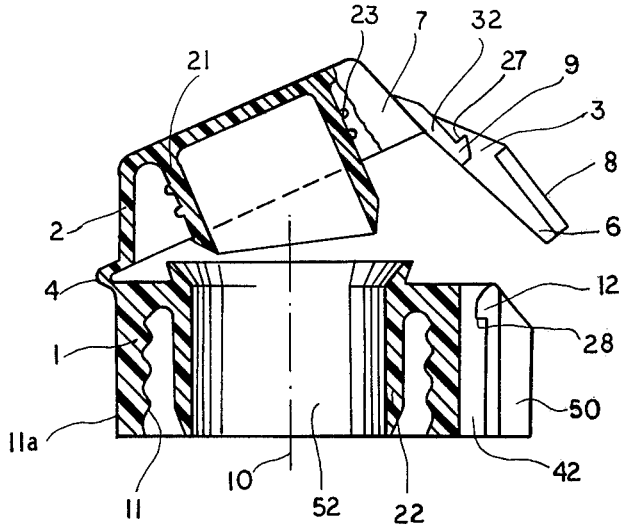
FIG. 2 the closure of FIG. 1 in section.
Figure 3:
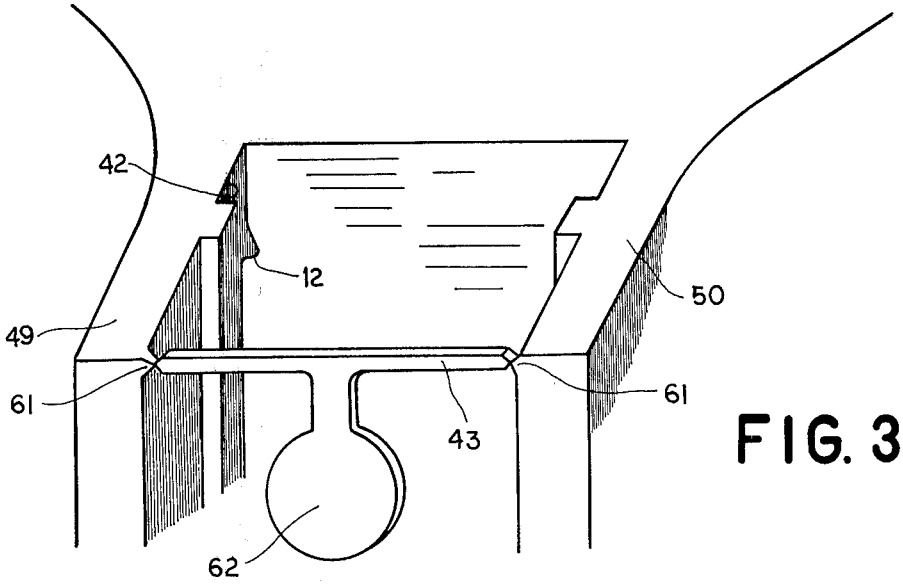
FIG. 3 the sealing band of a closure as shown in FIGS. 1 and 2 in perspective.

In closed condition, the cap 2 is being pressed against the base 1 by the hinge 4 and additional extendable strips not shown in FIGS. 1–3, as well as by the hook-shaped formation 9 and the detent pins 12. An upward movement of the cap, even upon development of high internal pressure or high ambient temperatures, is practically impossible, if the unit is produced according to the invention.

The opening of the unit is effected by first pressing the plate 8 substantially in a direction perpendicular to the closure axis 10, thereby releasing the hook-shaped formations 9 and the detent pins 12. By maintaining the pressure against pressing plate 8, the cap 2 is pushed upwardly and swung about the hinge 4. If for the hinge 4 a snap hinge is chosen, the cap 2 will spring upward into an open position and the content of the container upon which the closure has been mounted can be emptied through the discharge opening 52.

The here described closure can be provided with a sealing band as shown in FIG. 3, by bridging the outermost ends of the cheeks 49 and 50 with the sealing band 43. At both ends of the sealing band 43 there are the breakaway ligatures 61. In the middle of the sealing band 43 is the grip plate 62, which makes it possible to tear away the sealing band in a simple manner. During the initial closure of the unit, the projection 3 on the cap 2 can taper downwardly to a reduced thickness towards its end and can be readily inserted behind the sealing band 43. It is practically impossible for the projection 1 to slip in the opposite direction, without harming the sealing band 43. This has to be torn off previous to the opening of the closure.

Figure 5:
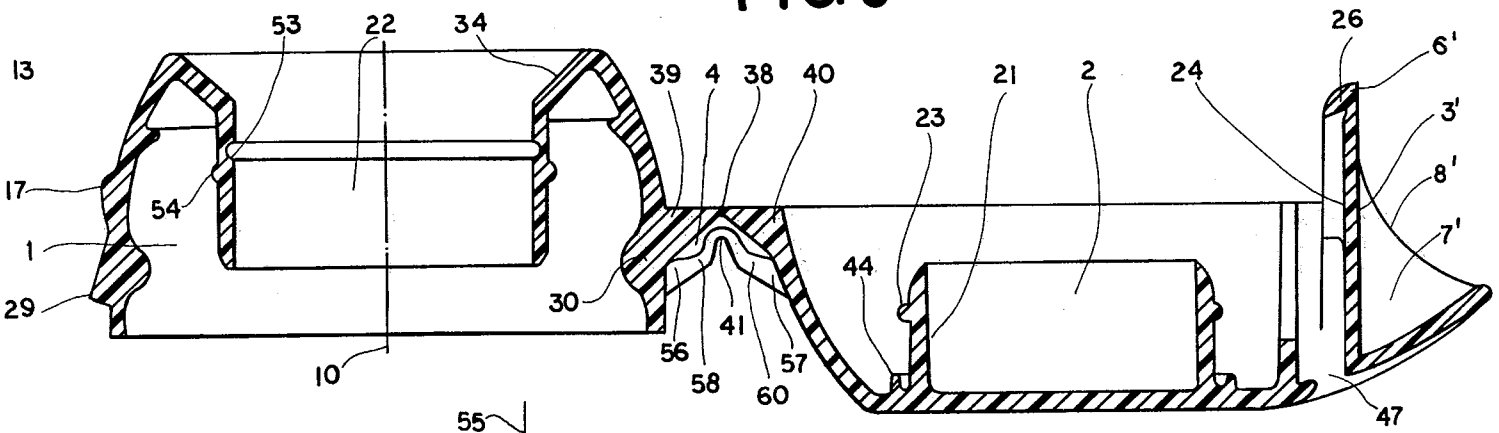
FIG. 5 a cross-sectional view of the closure according to FIG. 4 in open position.
Figure 4:
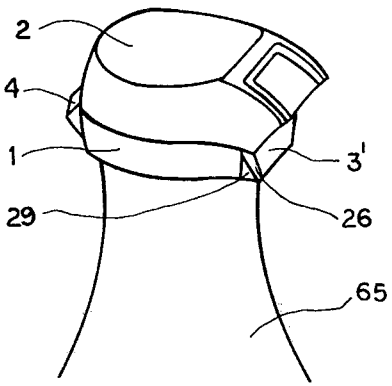
FIG. 4 a perspective view of the closure mounted upon the container.
Figure 6:
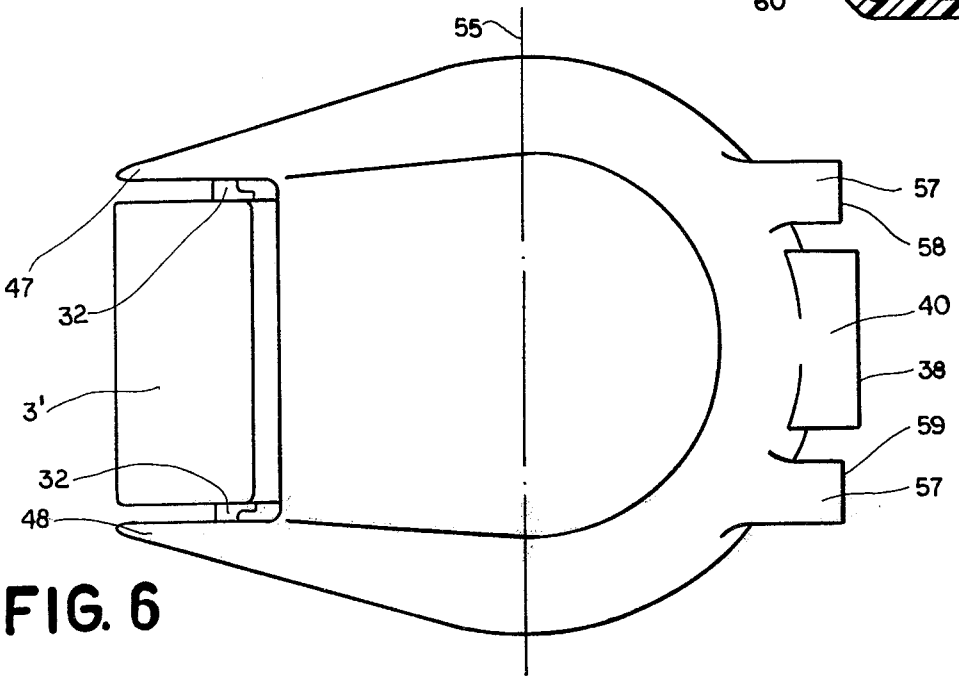
FIG. 6 a plan view of a closure according to FIGS. 4 and 5.

The FIGS. 4–6 show another embodiment of the invention. The closure here shown comprises also a base 1, a cap 2, a projection 3 and a hinge 4, which articulate the member 1 and the cap 2 to each other. The closure is mounted upon a container 65.

The base 1 is provided with a bead 30, which facilitates the pressing upon, and lifting up of, a corresponding counterpart on the container 65. This type of closure according to the invention, can be mounted upon container 65, which normally has a clenched cap or kork. In order to seal off the closure from the container, a sealing ring 13 is provided on the inner wall of the base 1 which bears inwardly against the upper neck of the container 65. In the center of the base 1, there is again a centering peg 22, provided on its outer periphery with a bead 54. Above the bead 54 on the inner part of the centering peg 22 there is a groove 53, which reduces the wall thickness of the peg 22. This embodiment permits the mounting of the base 1 on all types of containers 65 having an inner discharge diameter within a wide range. In the here described embodiment, the sealing peg 22 becomes adaptable in a simple manner to the differences in the inner diameter and ensues a perfect seal.

The cap 3 has been provided with a lever 3 having at its upper end 7 a pressing plate 8 and at its lower end 6 a hook-shaped formation 26. The lever 3′ is joint in its middle area 24 through the ribs 32 with the cheeks 47 and 48 molded to the cap 2. In the closed position of the closure, the hooks 26 engage the detent pin 29 to the base 1.

The cap 2 is also provided with a sealing peg 21 with at least one sealing ring 23. Concentric to the peg 21 is a support ring 44, which in the closed position of the closure rests upon the beveled part 34 of the centering peg 22. This support ring 44 prevents the deformation or displacement of the cap 2 relative to the member 1, while the closure is pressed or screwed on, which could make impossible a tight fit of the closure on the container 75.

Between the cap 2 and the lower member 1 is a hinge 4, which is constituted of a pair of cleats 39 and 40, their ends forming the hinge axis 38. The hinge 4 is diametrally opposed to the lever 3′. On both sides of the cleats there are provided respective projections 56, 57. The thinning ends of the projections 56 and 57 form a stretchable strip 41. The transition areas between the projections 56 and 57 and strips 41 form the pivot points 58, 59 and 60. The axis 38 of the hinge 4 is parallel to the transverse axis 55 of the closure.

The pivot points 58 and 59 are also parallel to the transverse axis 55. The parallel is closer to the transverse axis 55 than to the hinge axis 38. This arrangement permits the cap to spring when the lever is actuated, and in the close condition it permits the stretchable strips 41 to take over the forces acting upon the cap 2.

To open the closure, a pressure is applied to the pressing plate 8, approximately in right angle with the closure axis 10. This swings the lever 3′ around the ribs 32. This action is supported by the fact that the lever 3′ bears with its rear part against the tilting rib 17 which acts as a fulcrum. As soon as the hook 26 is released from the detent pin 29, by maintaining the above-mentioned pressure the cap 2 can be pushed upwardly and its springs open either by the inner pressure of the container 65 or by the force of the stretchable strips 41. The strips 41 maintain the cap in an open position and facilitate the emptying of the container 65 without difficulties. The cheeks 47 and 48 and the hooks 56, 57 are kept apart at a distance corresponding to the discharge diameter of the container 65.

Figure 7:
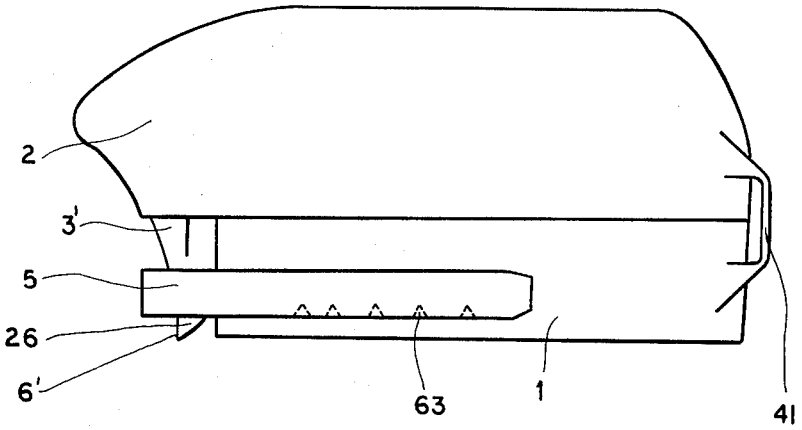
FIG. 7 a closure as in FIG. 4 having a sealing band.

FIG. 7 shows a closure of the type described in connection with FIGS. 4 through 6 but which is provided with a sealing strip 5. The closure according to the present invention can be injection-molded in the open position in one piece, the additional sealing band 5 being injection-molded to the base 1. This is connected to the outer wall of the base 1 through the breakaway ligatures 63. The space between the outer wall of the base 1 and the sealing band 5 is so dimensioned that during the initial closing of the unit the lower portion 6' of the lever 3' can be inserted between them. During this initial closing operation, the band is deformed without tearing the breakaway ligatures 63. To facilitate this, the lever 3' has to be formed with corresponding beveled surfaces. Release of the lever 3' is thus not possible without tearing the seal. This gives the consumer the possiblity to make sure that the container has not been opened previous to first use.

Figure 8:
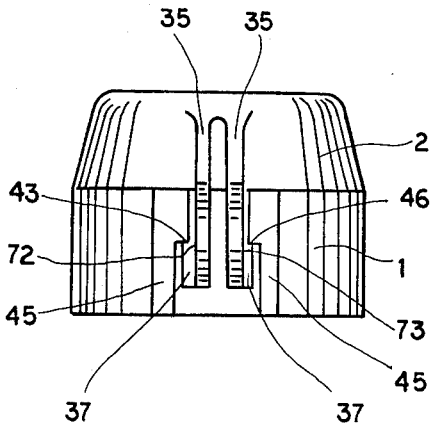
FIG. 8 a front perspective view of the closure.
Figure 9:
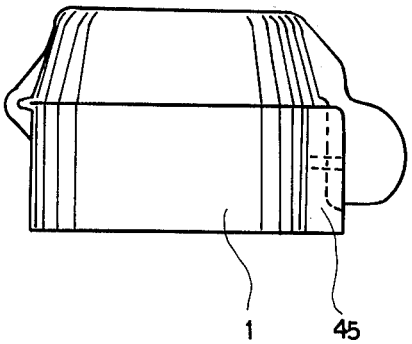
FIG. 9 a side view of the closure in FIG. 8.

FIGS. 8 and 9 show a closure whose projection is constituted in accordance with the principle of the single-arm lever, but which is activated in a different way. The extension is formed by two plate-shaped lugs 35 extending radially from the periphery of the closure and connected at their upper ends with the cap 2. At the lower ends of the lugs 35 pressing plates 36 are provided, having outwardly extending hook-shaped formations 37. On the base 1, on both sides of the lugs 35, there are the cheeks 45, provided each with a detent pin 46. In the closed position of the closure, the detent pins 46 engage with the hook-shaped formations 37 of the lugs, holding the cap 2 tightly mounted on the base 1.

As can be seen from FIG. 8, the effective surfaces 72, 73 of the detent formations 37 and 46 are undercut. By changing the degree of undercutting, the resistance to opening can be altered. The opening of the closure can be effected in this embodiment by pressing the plates 36 towards each other, thereby swinging open to the detent formations 37, 46 and moving the cap 2 upwardly, away from the base 1. Upon closure, the detent formations 37, 46 engage into each other due to the spring action of the lugs 35.

Figure 10:
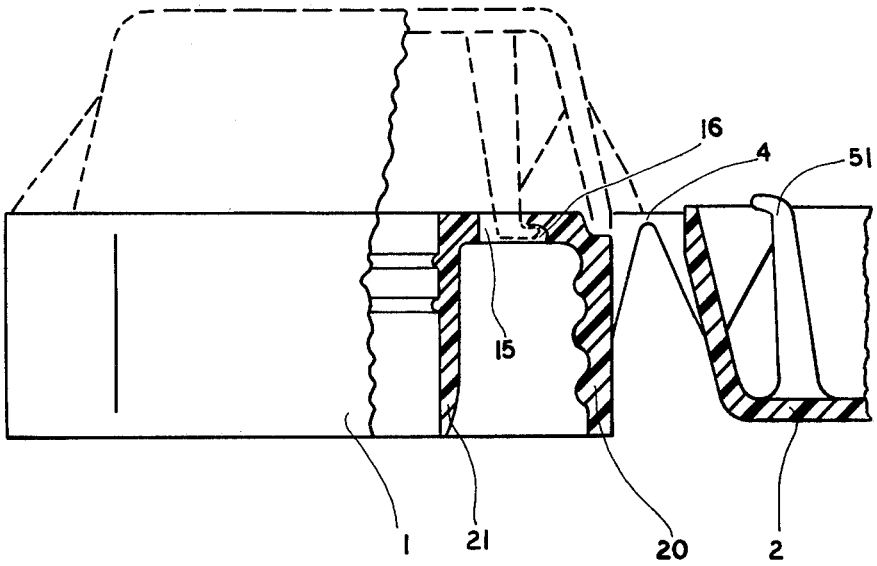
FIG. 10 a closure having an additional retaining hook in partial section.

FIG. 10 shows an arrangement for relieving the pressure upon hinge 4, system applicable to all the embodiments described in FIGS. 2, 4 and 8. In this embodiment, a hook is molded onto the rear part of cap 2, i.e. in the area of the hinge 4. Also, an opening 15 is provided on the rear side of the base 1, in the area of the hinge 4, the opening extending itself in the space between sealing peg 21 and the outer wall 20. The opening has a rear handle 16 engaging the end of the hook 51 rotating about the axis of the hinge 4. Particularly in the case of containers subjected to high inner pressure, the hinge 4 can be relieved thereby from a constant pressure. Simultaneously, it is possible to support the cap 2 close to the region where it is subjected to internal pressure from the container and thus to facilitate a better closing of the cap 2.

Figure 11:
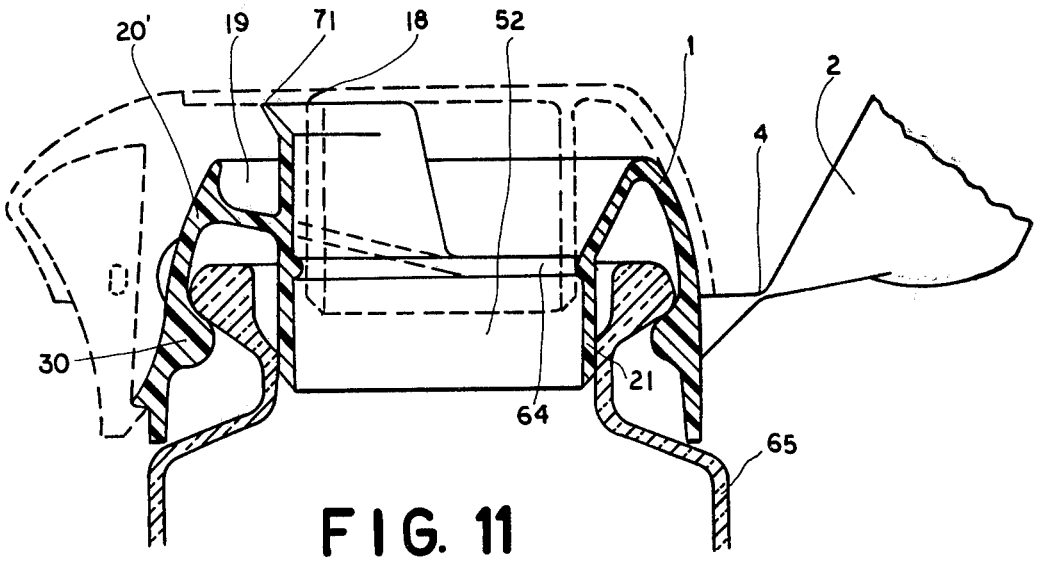
FIG. 11 a cross-sectional view of a closure having a discharge spout and a return chute or trough.

If the closure is intended to be applied to a container from which precisely measured quantities of liquid should be discharged, then the inner part of the closure has to have a special configuration, according to FIG. 11. In extension of the sealing peg 21, a pouring spout 18 is injection-molded to the base 1. This pouring spout 18 surrounds the discharge opening 52 at least partially. Preferably it is mounted across the hinge 4. Between the outer wall 20' of the base 1 and the pouring spout 18 a drop-collecting trough 19 is provided, which surrounds the pouring spount and has at least one return chute 64 in the discharge opening 52. The front end 71 of the pouring spout 16 is sharp edged so that it forms a breakaway edge. This configuration is necessary to avoid spilling of viscous liquids, as for instance oil and syrup, the sharp edge of the pouring spout preventing drop accumulation on the outside of the spout 18. If, however, due to inaccurate handling, droplets do ride down along the outer part of the pouring spout 18, they are collected in the trough 19 and returned to the container 65. The sealing of the closure might be identical to the ones previously described, being ensured by a sealing peg mounted to the cap 2, extending into the centering peg 21.

Figure 12:
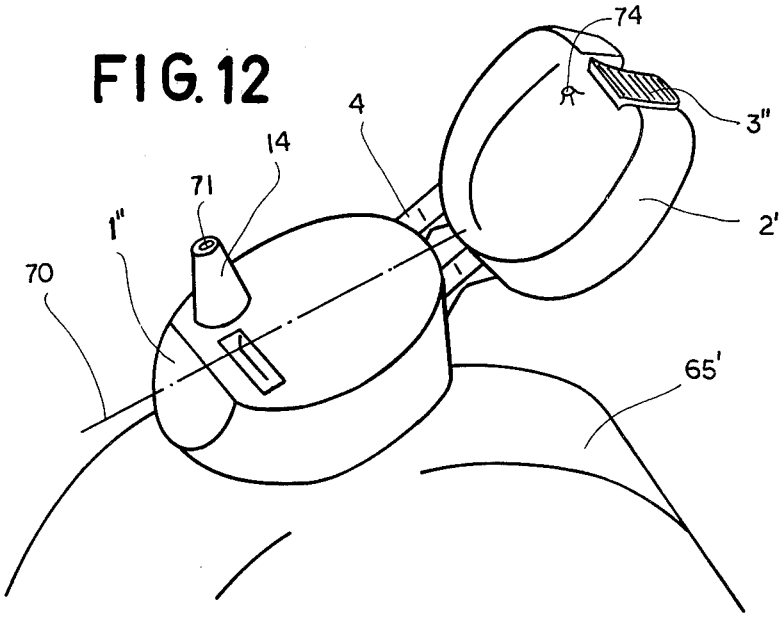
FIG. 12 a top diagonally cross-sectional view of a closure having a projection displaced from the middle area and a sunken recessed detent pin.
Figure 13:
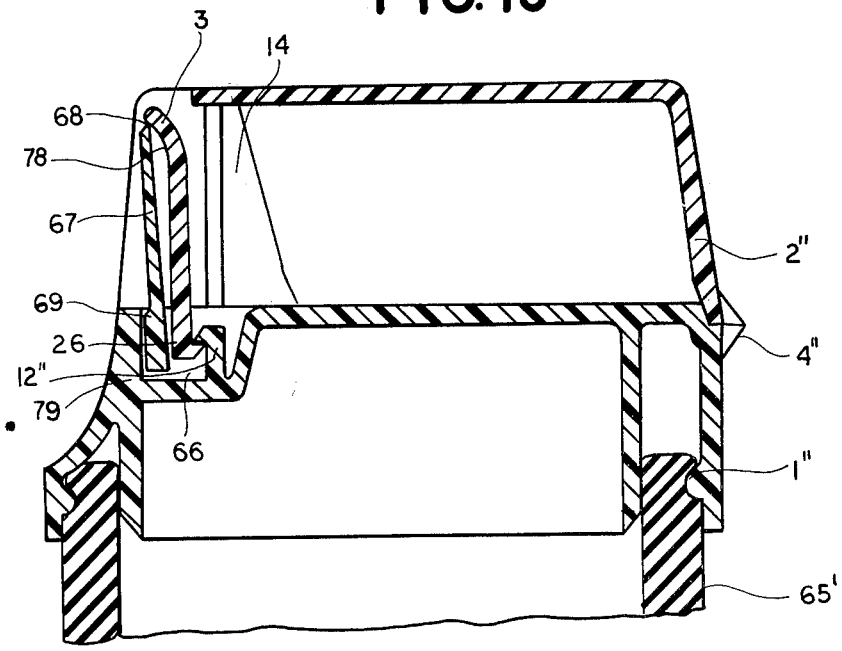
FIG. 13 a cross-sectional view of the closure of FIG. 12 provided with safety plate.

FIGS. 12 and 13 show a special embodiment of the closure according to the invention, especially effective for deformable containers 65. In this embodiment spigot 14 and a pressing plate 3' and the detent pin 12'' are placed opposite to the transverse axis 70 which extends through the center of the closure and the hinge 4. The outlet 71 in the spigot 14 has a sharply reduced cross-section in comparision with the discharge opening of the container 65. This is especially advantageous when small amounts of liquids, as for instance seasonings or pasty materials as cosmetics are to be discharged from the container. On the inner side of the cap 2'' a closure boss 74 is adapted, which in the closed position of the closure penetrates into the opening 71 of the spigot 14 and seals it. The spigot 14 is peg-shaped and injection-molded directly to the base 1''. The pressing plate 3'' has a similar conformation with the extension 3' in FIG. 5 and works under the same principle. The lower end of the pressing plate 3'' does not engage over the edge of the base 1'' but is received in a recess 66 formed therein. Within this recess a detent pin 12'' is provided, which cooperates with the hook 26'' and the lever 3' to prevent the opening of the cap 2'' as long as the lever 3'' is not actuated. Opening in this case is effected also by applying a force transverse to the axis of the closure against the upper end of the lever 3'', the latter acting as a a double-arm lever swung about its central fulcrum on the cap 2'' ro release the hook 26'' from the detent pin 12'' thereby releasing the cap 2''.

In FIG. 13 it is also shown how, in a special closure, a sealing plate 67 can be provided to prevent unintended opening of the unit or to indicate that it has been previously tampered with. The sealing plate 67 is connected through the breakaway junctions 68 with the lever 3'' so that the seal can be torn away easily in this area. The sealing plate 67 is formed in one piece with the cap 2'' and the base 1''. For the initial closing of the closure, the sealing plate together with the hook 26'' of the lever 3'' inserted into the recess 66 in the base 1''. The lower end of the sealing plate 67 is sufficiently thick to that it practically completely fills the space between the front wall 78, the pressing plate 3'' and the inner wall 79 of the recess 66. In order to facilitate insertion of the sealing plate 67, the lower end is slightly beveled on the outside. The sealing plate is provided with a lug not shown in the drawing, which facilitates the tearing away of the sealing-plate 67. Because of its thickened end 69 the sealing plate 67 prevents the undesired release of the hook 26'' from the detent pin 12''.

Figure 14:
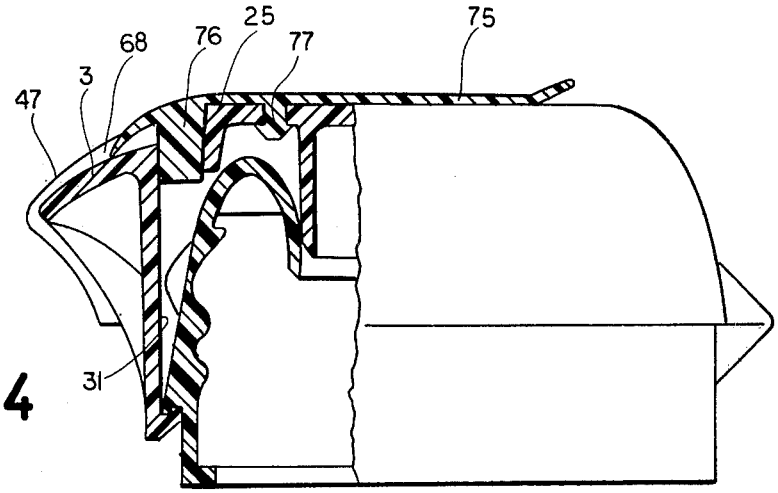
FIG. 14 the closure of FIGS. 4 to 6 provided with a special safety band.

FIG. 14 shows a further embodiment of a sealing strip or sealing plate 75 used for a closure type as shown in FIGS. 4–6. The same principle of the sealing strip applies also to the closure as shown in FIG. 1 and 8. The sealing band 75 is connected through breakaway joints 68 with the pressing plate 3' or the cheeks 47 of the cap 2. The breakaway joint 68 is so formed that it can be easily torn away by hand. On the pressing seal 75 there is a pin 76 and a safety pin 77. The sealing strip 75 is formed in one piece with the cap 1 and the base 2 during the injection-molding thereof. After closure of the unit, it is overlapping the closure, while the pin 76 engages between the rear wall 31 of the pressing plate 3' and the intermediate member 25 on the cap 2. The safety pin 77 is then forced into an opening in the surface of the cap and locks itself due to the corresponding arrangements. Between the sealing band 75 and the safety pin 77, a breakaway joint is provided. The safety device 77 can also be replaced by a spot weld or other similar arrangements. The pin 76 prevents the lever 3' from being actuated and the cap 2 from being opened. Prior to the initial opening of the closure, the sealing band 75 has to be torn away from the cap 2', releasing the pressing plate 3'.

Figure 15:
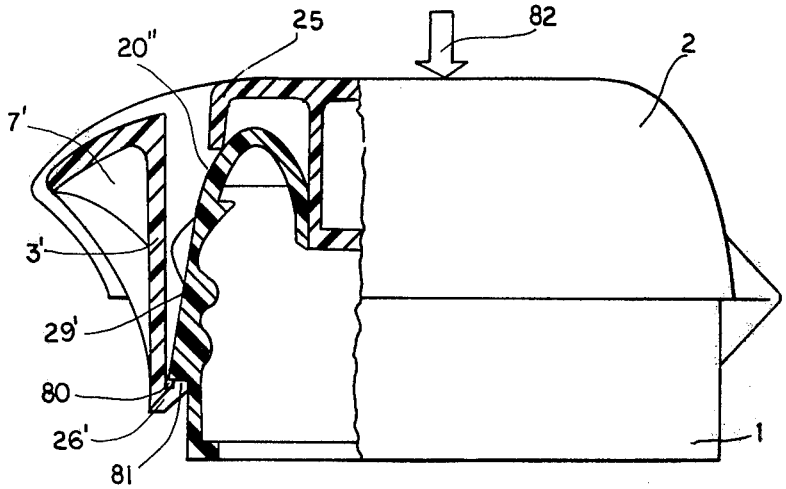
FIG. 15 the closure of FIGS. 4 to 6 with child-proof device in partial section.

FIG. 15 shows a closure similar to the one of FIGS. 4–6, here provided as a child-proof closure. In this embodiment, the hook-shaped formation 26' as well as the detent pin 29' are hook-shaped, so that these formations engage one behind the other in the direction of the closure axis. To open such a child-proof closure, a force must first be applied to the cap 2 in the direction of the arrow 82, thereby pressing the cap 2 against the base 1. This releases the locking elements 26' and 29' which can be swung open through pressure against the upper end 7' of the projection 3'. The opening of the cap 2 is then brought about by shifting the projection 3' and by pressing the cap inwardly while maintaining the pressure against the upper end 7' of the lever 3'. To hold the cap 2 in its closed position and to prevent a much too simple manner of opening it, an intermediate member 25 is provided. This intermediate member 25 bears against the outer wall 20" of the base 1 in the closed position of the unit. The memeber is so shaped that it can be deformed. To initially close the unit, the intermediate member 25 has to be deformed by a force applied in direction of arrow 82, so that the hook 81 on the lever 3' comes to be underneath the hook 80 on the pin 29'. By a corresponding prestressing of the lever 3' the hook-shaped formation 26' locks itself over the pin 29' and by releasing the pressure on the cap 2 the hooks 80 and 81 engages one into another. The intermediate member 25 is slightly prestressed and in a neutral position, while the unit is closed.

To open the child-proof closure a pressure is first applied on the cap 2 in direction of the arrow 82, until the two hooks 80, 81 clear one another. By maintaining this pressure in direction of the arrow 82 a transverse and upward force is applied to the upper end 7' of the lever 3' to release the hook 26' from the formation 29. Then the closure can be opened in the usual manner. The opening process requires both hands and the first movement is an application of an atypical force. These sequences of movement cannot readily be performed by children. Besides the degree of force to be applied can be determined by modifying the intermediate member 25, making it impossible at least for small children to open the closure. This child-proof closure is very appropriate for all contents which should not be accessible to children.

In order to prevent a simple removal of the closure by unscrewing or tearing away, the inner surface of the base 1 should be provided with the correspondingly dimensioned threads or pins, so that the closure could be removed only by machine or by using additional tools.

Figure 16:
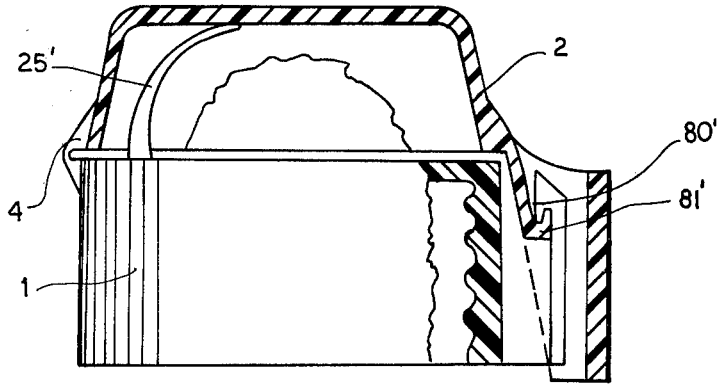
FIG. 16 the closure of FIGS. 1 to 3 with child-proof device in cross section.

FIG. 16 shows a closure in partial section, corresponding approximately with the one shown in FIG. 2, but having a hinge 4 without elastic strips. To replace these strips, in the rear area of the closure, close to the hinge 4 on the base 1 an intermediate member 25' is provided. This intermediate member 25' is relatively highly stressed while the unit is closed. The hooks 80 and 81 are shaped in this embodiment as to ensure a child-proof closure. To open the closure it is first necessary to press the cap downward to counteract the pressure of the intermediate member 25', releasing the hooks 80 and 81. By actuating the pressing plate the cap 2 can be pushed upwardly and the intermediate member 25' makes sure that the cap 2 springs open and is maintained in the open position. In this embodiment the yielding strips on hinge 4 can be replaced or the intermediate member 25' can be used in providing a child-proof closure.

The drawing shows a number of embodiments of the closure and various modifications and combinations of the details are possible. For example the latching lever can engage below a lower edge of the base instead of upon a specially provided detent formation.

Since the requirements for an ideal closure have been mentioned, it is necessary to see to what extent the aforedescribed embodiments of the invention fulfill these requirements.

The first requirement, to provide an easy opening and closing is fulfilled by all the aforedescribed closures. They all can be opened by a transverse upwardly directed pressure against the pressing plate. The cap 2 is not lost, since it is hinged to the base 1. The closure can be safely reclosed by backlapping and pressing the cap 2 until the hook 26 engages beneath the detent pin 29. The sealing beads on the peg or in the discharge opening ensure a tight sealing.

The second requirement, referring to the capability of the closure to withstand a certain amount of inner pressure, is provided by some special arrangements. The stretchable strips 41, which keep the initially opened cap in the open position, can be advantageously arranged on both sides of the film hinge as shown in FIG. 6. They keep the cap open, like in FIG. 5, by being relieved from stress. In the closed position of the closure, these strips are stressed as shown in FIG. 7. This way they provide a counterpressure to the inner pressure on the cap.

The annular sealing lip 13 (see FIG. 5) provides a tight sealing at the discharge opening of the bottle or container. A still more effective seal is provided under inner pressure, when the sleeve-like outlet 14 of the baes bears against the inner wall of the discharge opening of the bottle. The annular groove 53 affords a firm seat of the sleeve 22 in the bottle, by deformation of the bead 54. The annular bead 30 of the open closure shown in FIG. 11 provides a second sealing against the outer wall of the container.

When integral pressure is applied, the centering peg 22 being hollow is stretched against the bottle.

The third requirement is fulfilled by the closure made of polypropylene. In spite of the fact that this type of material may be softened by high temperatures, as they occur during pasteurization, the aforedescribed arrangements maintain the tightness of the seal.

The FIGS. 3, 7, 13 and 14 show how to provide the closure with a sealing band without major modifications. The closure can also be made child-proof without requiring considerable constructive modifications, as shown in FIGS. 15 and 16.

We claim:

1. A closure by synthetic-resin material for rigid or deformable containers having a base mountable on said container with at least one discharge opening; and a cap with a seal connected to said base by a hinge joint provided with at least one lever-type projection, said lever type projection being articulated to said cap and having at least one pressing plate, at least one hook-shaped formation and at least one detent pin on the base.

2. A container closure according to claim 1 wherein said lever-type projection is a lug-shaped lever elastically joined to the cap at its upper end, said pressing plate being provided at the lower end of said lever and said one hook-shaped formation intermediate said ends.

3. A container closure according to claim 1 wherein projection is a lever formed as a flap and elastically joined to said cap at an intermediate area, said pressing plate being provided at the upper end and said hook-shaped formation at the lower end of said flap.

4. A container closure according to claim 1 wherein the lever-type projection is formed by two lugs injection-molded to the cap and separated from one another by an intermediate space, the lugs carrying said pressing plate at each of their lower ends and being formed with at least one laterally extending hook, the base having two cheeks each with a detent pin cooperating with the hook.

5. A container closure according to claim 1, wherein the hook-shaped formation and the detent pin cooperate in the closed position of the unit.

6. A container closure according to claim 5 wherein effective surfaces of the formation and pin are perpendicular to the closure axis while the unit is closed.

7. A container closure according to claim 5 wherein effective surfaces of the formation and pin form an angle perpendicular to the closure axis enabling the self-locking of the unit in the closed position.

8. A container closure according to claim 5 wherein effective surfaces of the formation and pin are undercut.

9. A container closure according to claim 1 wherein the hinge joint is a film hinge with a hinge axis formed between two cleats molded to the base and the cap, said cleats having on both sides support elements bridged by two stretchable strips, fulcrums of the strips being spaced closer to the transverse axis of the closure than to the hinge axis, whereby the two fulcrums of the stretchable strips at the base and the cap coming to lie along a line parallel to the axis of the unit in closed position.

10. A container closure of synthetic resin according to claim 1, wherein a hook is injection-molded to the cap close to the hinge joint and at the base, between the outer wall and the sealing peg, a recess with a rear handle is provided, the hook engaging into the rear handle through the recess in the closed position of the unit.

11. A container closure according to claim 3, wherein the base has a centering peg with a discharge opening and the cap has a sealing peg which in the closed position of the unit is concentrically placed with respect to the centering peg.

12. A container closure according to claim 11, to wherein the sealing peg has at least one sealing ring on its outer wall.

13. A container closure according to claim 12 wherein the centering peg has at least one wall area thinner than the rest and a bead on the outer wall, said bead being placed to fit into the interior of the discharge opening when the closure is mounted onto a container.

14. Closure according to claim 3, wherein a support ring is provided on the cap.

15. A container closure according to claim 3 having on the base a ring bearing against the discharge opening of a container.

16. A container closure according to claim 2 wherein the lever has two laterally molded ribs, provided at their ends with a hook and the base has two cheeks provided with detent pins and guide channels to guide the lever during the closing of the unit, the arrangement of pins, channels and ribs enabling the ribs and the hooks in the guide channel and the detent pins.

17. A container closure according to claim 1 wherein a sealing band is provided on the base between cheeks said band being connected to the cheeks through breakaway joints having a gripping plate.

18. A container closure of synthetic resin according to claim 3 wherein the cap is provided at tis periphery with a pair of sapced-apart cheeks, the lever being shaped like a pressing plate and being disposed between them, said lever being connected to said cheeks resiliently by connecting bridges, the distance between the cheeks corresponding substantially to the diameter of the discharge opening of the closure.

19. A container closure according to claim 18 wherein the base has a tilting member placed above a pin, said tilting member being at substantially the same height as the connecting bridges in the closed position.

20. A container closure of synthetic resin according to claim 18 wherein a sealing band is unitarily formed with the cap, the sealing band sealing ghe pressing plate in the region of the hook-shaped formation, said sealing band being connected to the base through several breakaway points at the periphery of the base.

21. A container closure according to claim 3 wherein the base has a discharge opening surrounded at least partially by a sharp-edged spout, said spout being surrounded with a a collecting trough having at least one return chute in the opening.

22. A container closure according to claim 2 wherein a spigot, the pressing plate and the detent formation L are offset from a transverse axis extending through the center of the closure and of the hinge joint and a discharge opening is provided which has a sharply reduced cross-section by comparison with that of a container on which the closure is mounted.

23. A container closure according to claim 22 wherein the detent formation is provided in a recess of the base.

24. Closure according to claim 23 wherein a sealing plate is connected by breakaway junctions to the lever, in the closed position of the unit, the end of said plate being inserted into the recess and said end being sufficiently thickened so as to prevent the release of hook from the detent pin.

25. A container closure according to claim 2 wherein a sealing band is connected by a breakaway junction to a covering plate, said sealing band having a pin and a safety device, the pin of the sealing band being receivable in a space between the pressing plate and the cap preventing swinging of the covering plate.

26. A method for actuating a closure for a container, said closure being connected to said container by a base whose cap is openable by swinging it about a hinge joint, according to which method first a pressing force is applied in a direction perpendicular to the closure axis, releasing a latch, and then by maintaining this force, pressure is applied in the direction of the closure axis, whereby, at least in the initial period of the opening process both forces, the one applied perpendicularly to the closure axis and the one applied parallelly to the axis, acting simultaneously a force being applied to the cap of the closure in the direction of an arrow, pressing the cap against the base and deforming a resilient member, thereby releasing the self-locking arrangement of the latch, and wherein by applying a force perpendicular to the closure axis immediately thereafter, the latch is released and the closure is opened.

27. A container closure according to claim 2 wherein the formations on the pressing plate and the detent pin are hook-shaped and the hooks engage behind one another in the direction of the closure axis and wherein at least one resilient member is provided between the cap and the base, said resilient member being deformed to disengage the hooks.

28. A container closure according to claim 27 wherein the resilient intermediate member is provided on the cap.

29. A container closure according to claim 27 wherein the intermediate member provided on the base is a lever-type formation in the rear area of the closure.

30. A container closure according to claim 1 which is made from polypropylene.

* * * * *